US006856301B2

(12) United States Patent
Walker et al.

(10) Patent No.: US 6,856,301 B2
(45) Date of Patent: Feb. 15, 2005

(54) PLASMA PHASED ARRAY ELECTRONIC SCAN ANTENNA

(75) Inventors: Joel F. Walker, Malibu, CA (US); Daniel G. Gonzalez, Topanga, CA (US)

(73) Assignee: Malibu Research Associates, Camarillo, CA (US)

( * ) Notice: Subject to any disclaimer, the term of this patent is extended or adjusted under 35 U.S.C. 154(b) by 99 days.

(21) Appl. No.: 10/427,705

(22) Filed: Apr. 30, 2003

(65) Prior Publication Data

US 2003/0218575 A1 Nov. 27, 2003

Related U.S. Application Data

(60) Provisional application No. 60/377,086, filed on May 1, 2002.

(51) Int. Cl.[7] ..... H01Q 21/00

(52) U.S. Cl. ..... 343/853; 343/700 MS; 343/778

(58) Field of Search ..... 343/700 MS, 778, 343/793, 853, 893

(56) References Cited

U.S. PATENT DOCUMENTS 3,235,768 A * 2/1966 Magnuski ..... 315/39

6,535,168 B1 * 3/2003 Marumoto et al. .. 343/700 MS

* cited by examiner

*Primary Examiner*—Shih-Chao Chen

(74) *Attorney, Agent, or Firm*—Hoffmann & Baron, LLP

(57) ABSTRACT

A phased array antenna includes phase shifting elements, drivers, and antenna elements. The phase shifting elements are operatively coupled to first signals and second signals, and include at least one plasma electrode. The drivers selectively energize the plasma electrode and the phase shifting elements provide a phase shift between the first and second signals in response to the plasma electrode being energized. The antenna elements are operatively coupled to the phase shifting elements. A method of phase shifting an array antenna includes the steps of providing phase shifting elements operatively coupled to first signals and second signals, and incorporating at least one plasma electrode in the phase shifting elements. The method also includes the steps of selectively energizing the plasma electrode, shifting the phase between the first signals and second signals in response to the plasma electrode being energized, and operatively coupling antenna elements to the second signals.

31 Claims, 27 Drawing Sheets

Conventional Pin Diode Bit

Plasma Bit

FIG. 16A
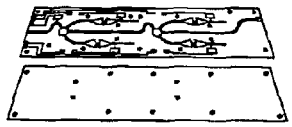
FIG. 16B
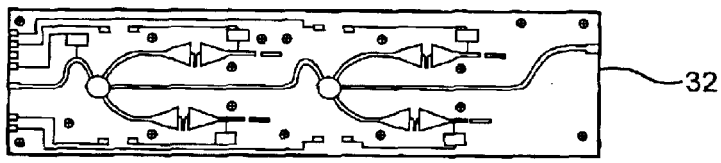
FIG. 17A
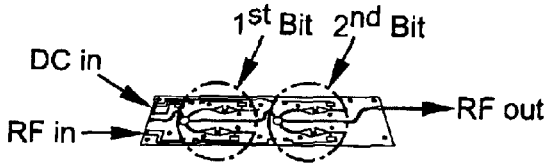
FIG. 17B
| Board # | No Plasma (All Bits OFF) | | 1st Stage Fired (1st Bit ON) | | 2nd Stage Fired (2nd Bit ON) | | Both Stages Fired (Both Bits ON) | |
|---|---|---|---|---|---|---|---|---|
| | Meas. | Relative | Meas. | Relative | Meas. | Relative | Meas. | Relative |
| 1 | 87° | 2° | 176° | 91° | 143° | 58° | -126° | 149° |
| 2 | 84° | -1° | -173° | 102° | 144° | 59° | -107° | 168° |
| 3 | 92° | 7° | -176° | 99° | 142° | 57° | -113° | 162° |
| 4 | 85° | 0° | -179° | 96° | 142° | 57° | -116° | 159° |
| 5 | 79° | -6° | -173° | 102° | 141° | 56° | -109° | 166° |
| 6 | 74° | -11° | 172° | 87° | 141° | 56° | -120° | 155° |

Measured Antenna Pattern

Measured Antenna Pattern

PLASMA PHASED ARRAY ELECTRONIC SCAN ANTENNA

CROSS-REFERENCE TO RELATED APPLICATION

This application claims the benefit of U.S. Provisional Application Ser. No. 60/377,086, filed May 1, 2002, the disclosure of which is incorporated herein by reference.

The U.S. Government has a license in this invention and the right in limited circumstances to require the patent owner to license others on reasonable terms as provided for by the terms of Contract No. N00039-97-C-0069 awarded by the Space and Naval Systems Command COM SPAWAR SYSCOM.

BACKGROUND OF THE INVENTION

1. Field of the Invention

The present invention relates to antenna arrays and more particularly to the use of plasma technology as a phase shifting mechanism in electronically scanned array antennas.

2. Description of the Prior Art

For over 40 years, the industry has searched for a solution to the prohibitive cost of electronic-scan phased array antennas with essentially little success. It is been universally recognized that inertialess electronic-scan antennas offer countless system benefits. However, excessive production costs have proven insurmountable, except in a very few, select, costly instances.

OBJECTS AND SUMMARY OF THE INVENTION

It is an object of the present invention to provide an electronically scanned phase array antenna that is reliable, efficient, accurate, robust, compact, readily manufacturable in mass quantities, and cost-effective.

It is another object of the present invention to provide an electronically scanned phase array antenna that utilizes plasma technology as a mechanism to shift the phase of signals in the array.

It is yet another object of the present invention to provide an electronically scanned phase array antenna that realizes the advantages inherent with plasma hysteresis to reduce the quantity of drivers required to energize phase shifting elements in the array.

It is a further object of the present invention to provide an electronically scanned phase array antenna, in which phase shifting elements include plasma electrodes that may readily be fabricated using stripline or microstrip technology.

It is still a further object of the present invention to provide am electronically scanned phase array antenna that may be scanned in azimuth and elevation.

A phased array antenna formed in accordance with one form of the present invention, which incorporates some of the preferred features, includes a plurality of phase shifting elements, a plurality of drivers, and a plurality of antenna elements. The phase shifting elements are operatively coupled to first signals and second signals and include at least one plasma electrode.

The drivers selectively energize the plasma electrode in the phase shifting elements. The phase shifting elements provide a phase shift between the first signals and the second signals in response to the plasma electrode being selectively energized. The antenna elements are operatively coupled to the phase shifting elements.

A method of phase shifting an array antenna in accordance with one form of the present invention, which incorporates some of the preferred features, includes the steps of providing a plurality of phase shifting elements, coupling the phase shifting elements operatively to first signals and second signals, and incorporating at least one plasma electrode in the phase shifting elements. The method also includes the steps of selectively energizing the plasma electrode, shifting the phase between the first signals and second signals in response to the plasma electrode being selectively energized, and operatively coupling antenna elements to the second signals.

These and other objects, features, and advantages of this invention will become apparent from the following detailed description of illustrative embodiments thereof, which is to be read in connection with the accompanying drawings.

BRIEF DESCRIPTION OF THE DRAWINGS

FIG. 12*a* is a graph of forward reflection as a function of frequency for the apparatus shown in FIG. 10 with the plasma on.

FIG. 12*b* is a graph of forward transmission as a function of frequency for the apparatus shown in FIG. 10 with the plasma on.

FIG. 16*a* is a pictorial view of a phase shifting element formed in accordance with the present invention.

FIG. 16*b* is a layout diagram of the phase shifting element shown in FIG. 16*a*.

FIG. 17*a* is a pictorial view of a two-bit plasma phase shifting element formed in accordance with the present invention.

FIG. 17*b* is a table of phase results concerning the phase shifting element shown in FIG. 17*a*.

FIG. 37*a* is a graph of forward reflection as a function of frequency for the apparatus shown in FIG. 35 with the plasma on.

FIG. 37*b* is a graph of forward transmission as a function of frequency for the apparatus shown in FIG. 35 with the plasma on.

FIG. 38*a* is a graph of forward reflection as a function of frequency for the apparatus shown in FIG. 35 with the plasma on.

FIG. 38*b* is a graph of forward transmission as a function of frequency for the apparatus shown in FIG. 35 with the plasma on.

DETAILED DESCRIPTION OF THE PREFERRED EMBODIMENTS

The subject invention addresses the issue of developing a phased array fabrication technology that reduces the associated cost of manufacturing such an antenna by a factor of about twenty.

The present invention is based on merging two technologies:

1. plasma generation along with its latching capabilities; and
2. interaction of microwaves with a plasma field.

Figure 1A:
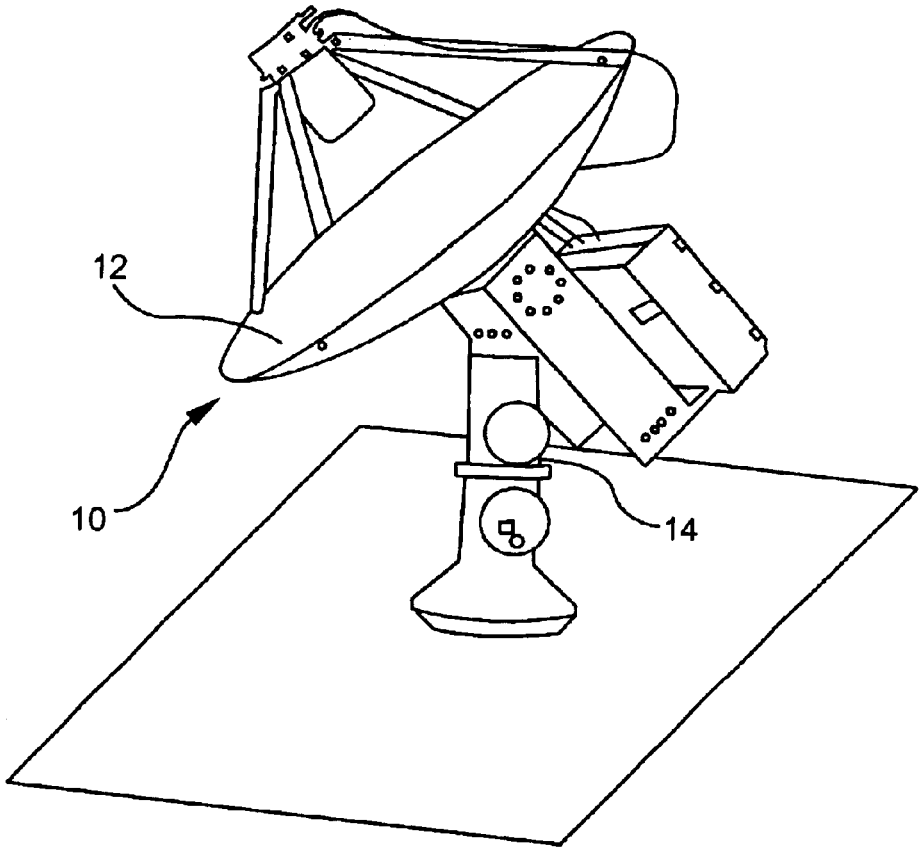
FIG. 1A Prior Art
FIG. 1 is a pictorial view of a conventional mechanically scanned array antenna.
FIG. 1*b* is a pictorial view of a conventional electronically scanned array antenna.

A typical antenna 10 using conventional mechanical positioners is shown in FIG. 1*a*. The antenna 10 preferably includes a parabolic reflector 12 mounted on a controllable elevation-over-azimuth positioner 14. These types of systems are very robust and reliable. However, they have the disadvantage of sweeping out a volume that is much larger than the system itself. This can place severe constraints on a system, such as those installed on shipboard, where space is very limited.

Figure 1B:
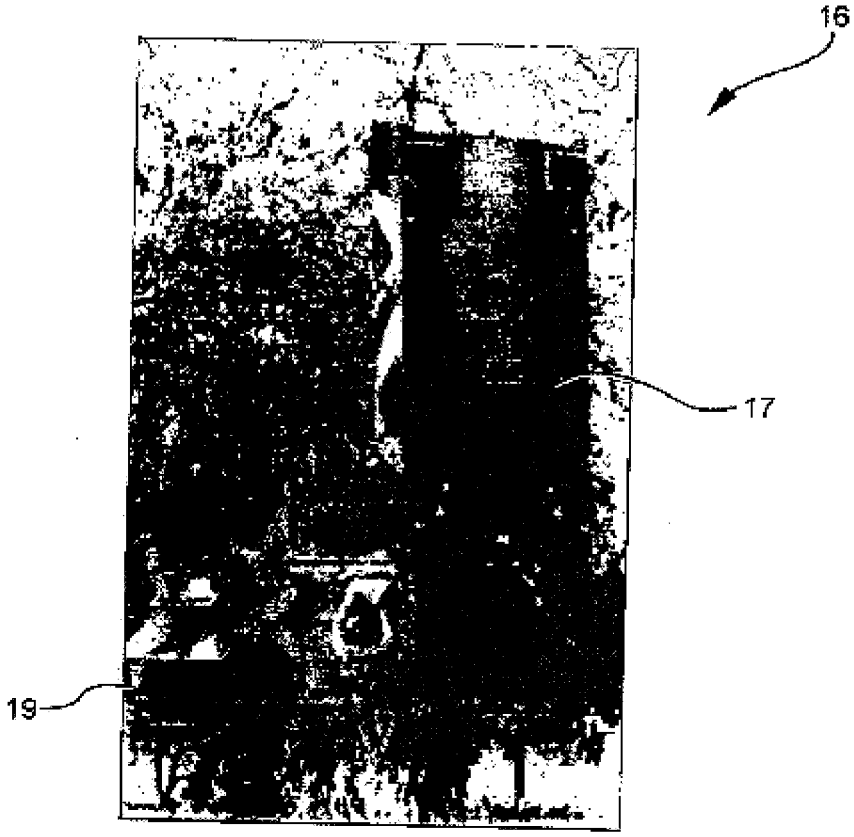
FIG. 1B Prior Art

An electronic-scan antenna, however, results in a minimum footprint that in most cases is as small as the space it occupies. A representative electronic-scan or phased array antenna 16 is shown in FIG. 1*b*. This system is the Army TPQ-37 artillery and mortar locating radar. An electronic scan array 17 is the box like structure erected to a vertical position in FIG. 1*b*. Once erected, nothing on the system moves.

A RF (radio frequency) beam is formed and scanned substantially without inertia using electronic controlled phase shifters within the array 17. A trailer 19 preferably contains the support equipment (i.e. transmitter, receiver, etc.). It is readily evident that the footprint of the box like structure is relatively small. The primary disadvantage of electronic scan antennas is the enormous cost associated with their development and fabrication. Typically, the cost of a system employing a phased array is 10 to 100 times more expensive than a comparable mechanical gimbal system shown in FIG. 1*a*.

Figure 2A:
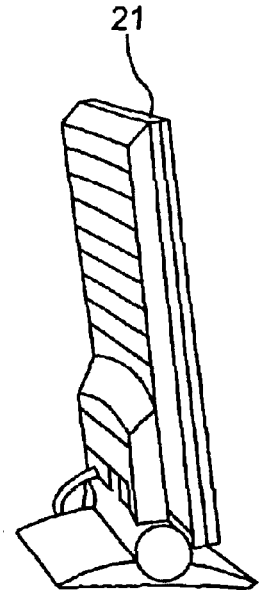
FIG. 2A Prior Art
FIGS. 2*a* and 2*b* are side and front pictorial views, respectively, of a conventional plasma video display.
Figure 2B:
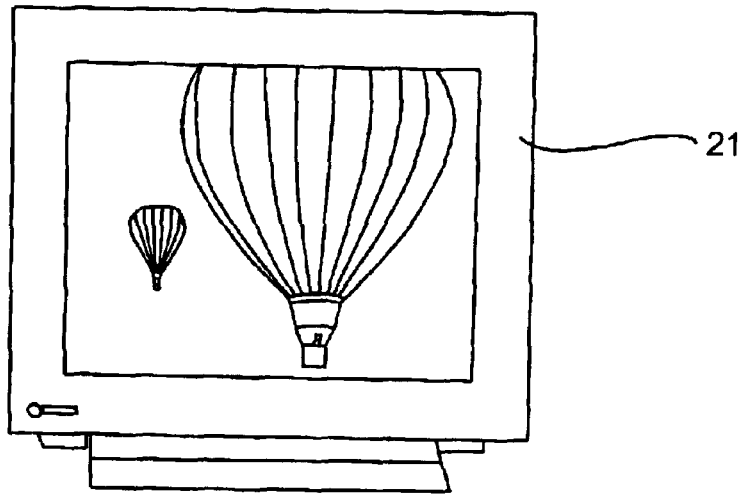
FIG. 2B Prior Art

The subject invention is based on a phased array antenna using gas discharge video display technology shown in FIGS. 2*a* and 2*b*. Plasma video displays are becoming commercially available for under $1000, with ultimate projections to be under $500. This projection is due to the straightforward methods used in the construction of such displays.

The technique commonly used to manufacture plasma video displays, which include the following elements, is best described with reference to FIG. 3:

1. two glass sheets 18;
2. an electrodeposited circuit 20;
3. hysteresis or memory;
4. a row/column steering circuit (pixel electrodes); and
5. a low voltage switching power supply circuit 24.

The fabrication preferably begins with two simple panes of glass 18 separated by a gas sealing spacer 22. Prior to assembly, parallel low voltage electrical wires 20 are preferably electrodeposited on one face of each glass pane 18. The panes 18 are preferably arranged such that the parallel wire grids 20 are at right angles to each other and closely separated by the spacer 22.

Figure 3:
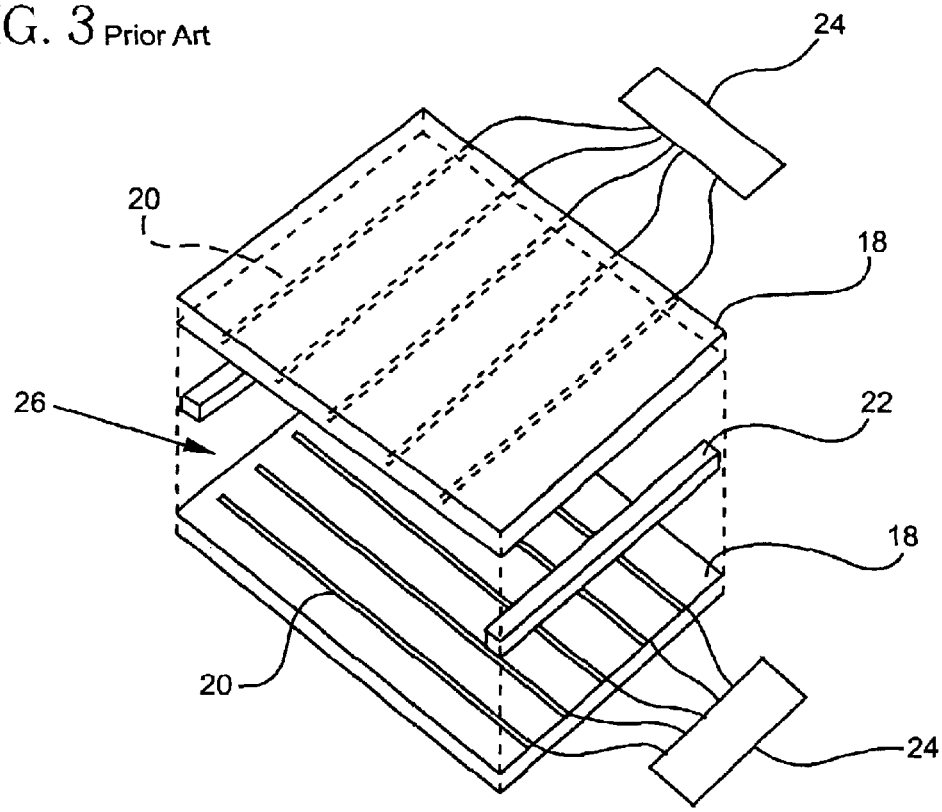
FIG. 3 Prior Art
FIG. 3 is an exploded view of a conventional plasma video display.

The wires 20 are then connected to two sets of drivers 24 (one for the vertical axis and the other for the horizontal axis) as shown in FIG. 3. A vacuum is preferably applied to the assembly, and the system is then backfilled with a low-pressure gas 26.

Figure 4:
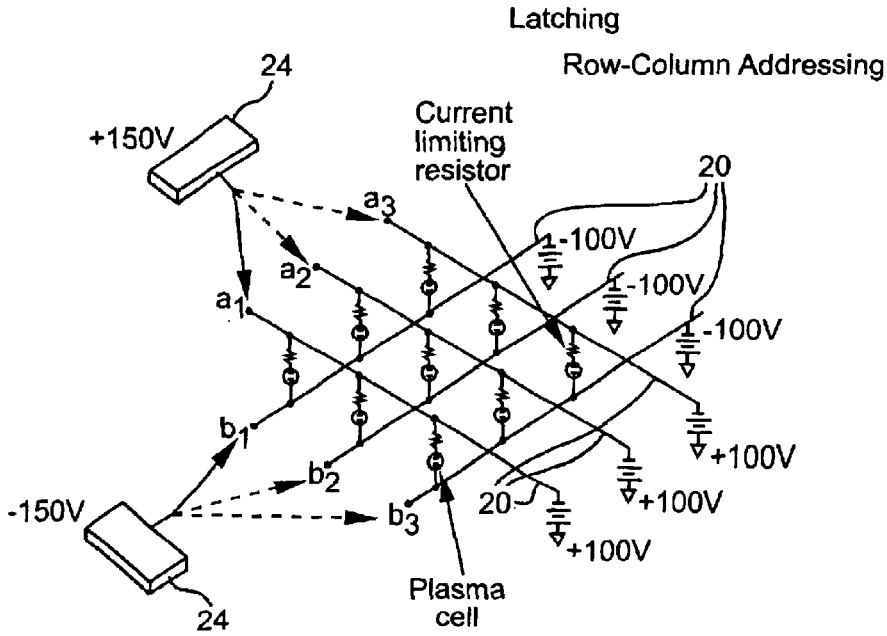
FIG. 4 Prior Art
FIG. 4 is a schematic block diagram of a conventional plasma video display.

The electrical schematic of the final assembly is shown in FIG. 4. When a sufficient voltage is applied to any two intersecting wires, a plasma pixel will fire, that is, form a plasma, which is localized near the intersection. As can be seen, the basic video system is extremely simple to construct, which is one of the primary reasons for its low cost.

Another reason for the low cost is that the assembly preferably only requires two driver circuits 24 (switching power supplies)—one for the vertical axis and one for the horizontal axis. This is possible due to the hysteresis phenomenon exhibited by gaseous plasma. The hysteresis (or memory) is best explained by reference to FIG. 5.

Figure 5:
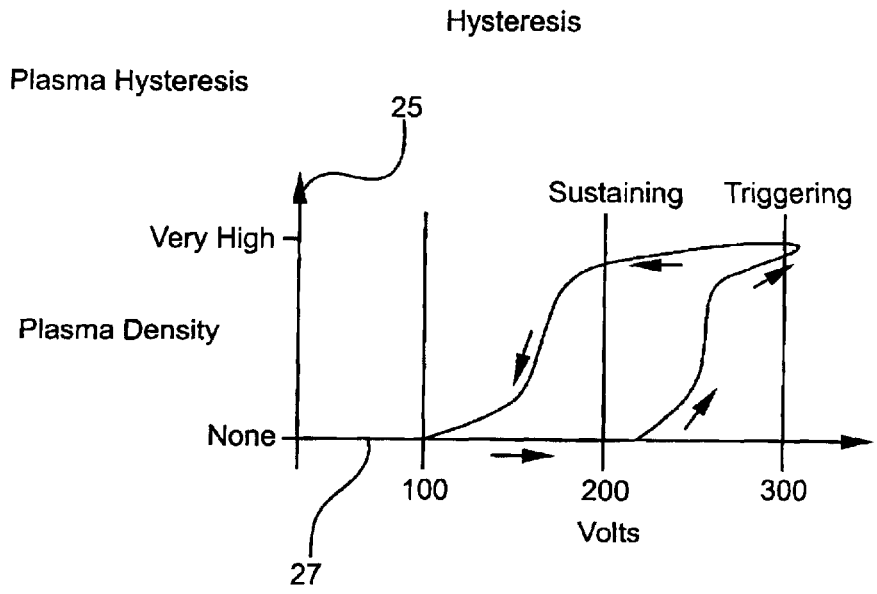
FIG. 5 is a graph of plasma density as a function of applied voltage.

A vertical axis 25 in FIG. 5 is a measure of the plasma electron density, which ranges from none to very high. A horizontal axis 27 preferably represents the voltage impressed on two intersecting lines. As the voltage increases, a level is reached where the plasma starts to fire at an upper threshold level, which is about 220 volts in this example. As the voltage is increased further, the plasma density increases and approaches a saturation level at about 300 volts.

If the voltage is then decreased, the plasma level decreases very slowly and becomes self-sustaining due to a so-called "electron avalanche effect". In this region, the plasma remains fired at a high level until the voltage is decreased well below a lower threshold level of about 100 volts.

Thus, for a video display application, two voltage levels are preferably provided: 1) a sustaining level of preferably about 200 volts; and 2) a triggering level of preferably about 300 volts. It is to be noted that the sustaining level is preferably well below the threshold level of about 100 volts and, by itself, cannot start the plasma effect, but merely sustains it subsequent to triggering.

With reference to FIG. 4, a screen updating process preferably includes the following sequence of steps:

1. setting the output voltages of both driver circuits 24 to about zero volts, which essentially clears the screen;
2. setting and holding the output voltages of both driver circuits 24 to a constant sustaining voltage of about 200 volts, which is insufficient to start the plasma effect;
3. sequentially performing either one of the following steps at each and every intersection of wires or pixels by logic in the circuit drivers 24:
   a) applying the triggering voltage momentarily to start the plasma effect and maintaining the sustaining voltage once the triggering voltage is removed to maintain pixel firing, or
   b) skipping the pixel by not applying the triggering voltage; and
4. repeating steps 1–3 many times a second to refresh the screen.

Thus, drivers are only required for each row and column of the pixel matrix, rather than for each pixel in the matrix.

Typical plasma display properties are shown in Table 1 below. A high resolution video plasma display that, for example includes 1280×1024 pixels and three colors, must switch approximately 3.9 million plasma pixels on or off several times per second.

Figure 6B:
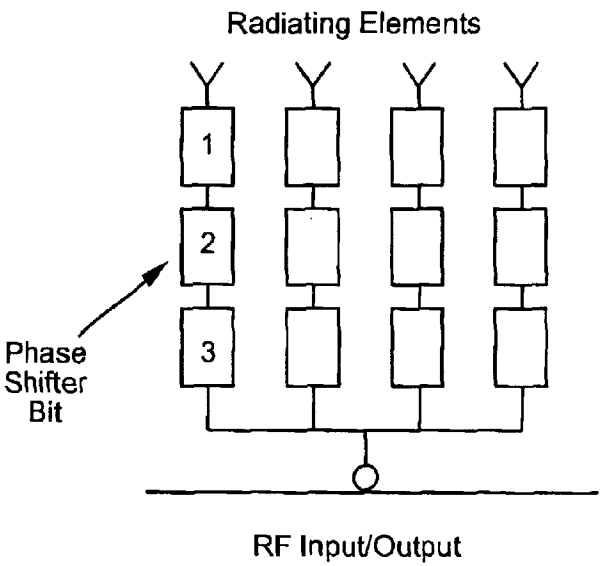
FIG. 6B Prior Art
FIG. 6*b* is a block diagram of a conventional electronically scanned antenna array.
Figure 6A:
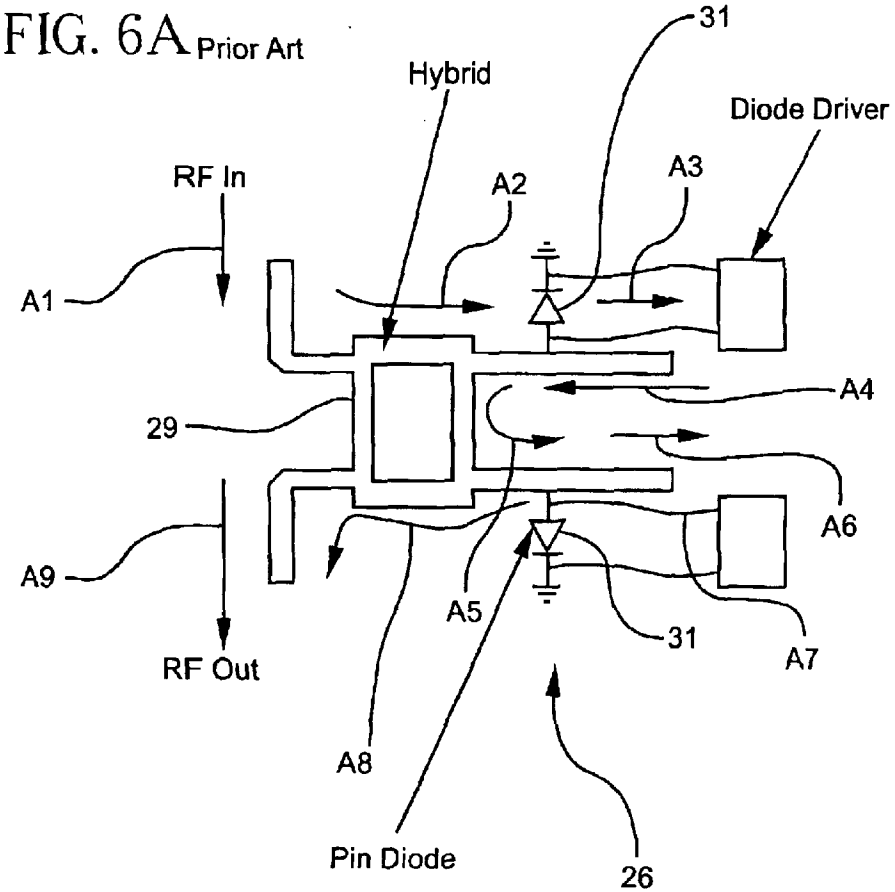
FIG. 6A Prior Art
FIG. 6*a* is a schematic diagram of a phase shifter bit for use in a conventional electronically scanned antenna array.

An electronic-scanning microwave antenna phase shifting bit is shown in FIG. 6*a* and preferably includes pin diodes 31 that play a similar role to switching pixels in a plasma display. In FIG. 6*a*, the path of an RF signal is preferably directed by a hybrid 29 and shown sequentially by arrows A1–A9 when the pin diodes are driven to an off state. If the pin diodes 31 are driven to an on state, that portion of the RF signal path indicated by arrows A3, A4, A5, and A7 is preferably eliminated due to grounding of the transmission line by the pin diodes 31. FIG. 6*b* shows a block diagram of the use of multiple phase shifting elements, such as that shown in FIG. 6*a*, within a phased array antenna system.

The pin diodes 31 preferably include a large intrinsic region between the p- and n-doped semiconductor regions, and are turned off and on (reset) for each beam position. An electronic scanning antenna having 10,000 active elements (100 rows by 100 columns) is, by conventional standards, very large.

TABLE 1

| Plasma Display Properties |
|---|
| He/Xe gas cells, which are preferably 1 mm × 1 mm; |
| triggering voltage of about 300 volts and sustaining voltage of about 200 volts; |
| 21" display preferably uses 100 watts and includes 640 × 480 pixels; |
| row/column addressable; |
| about 30 microseconds to discharge a cell; |
| pixels about 0.2 mm to 1 mm or greater; and |
| commercially available for use as high-end flat displays |

Assuming 3-bit diode phase shifters, the array preferably requires about 30,000 pin diodes, which is about 130 times less than the analogous number of pixels required for the plasma display. The present invention includes the development of a plasma pixel within a printed microwave stripline or microstrip circuit.

Figure 7A:
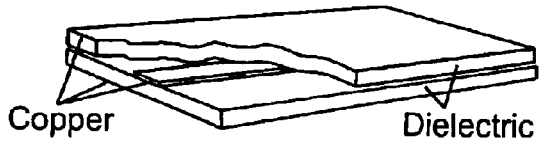
FIG. 7A Prior Art
FIGS. 7*a*, 7*b*, and 7*c* are cross-sectional and exploded views of circuit layouts fabricated using stripline technology.
Figure 7B:
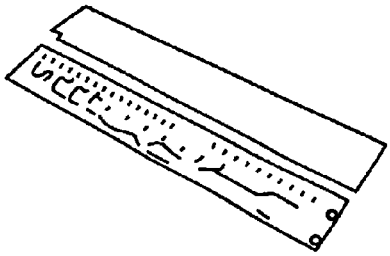
FIG. 7B Prior Art
Figure 7C:
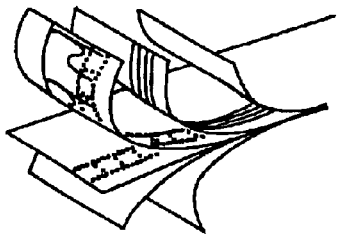
FIG. 7C Prior Art

A stripline RF (radio frequency) transmission line technique is shown in FIGS. 7*a*–*c*. The developed pixel preferably interacts with microwave energy, when energized, such that it can be used as a switching element. However, in the present invention such a circuit is preferably constructed as an inexpensive photo-etched printed circuit to fully utilize the benefits of low-cost production.

Array Comparison

Figure 8A:
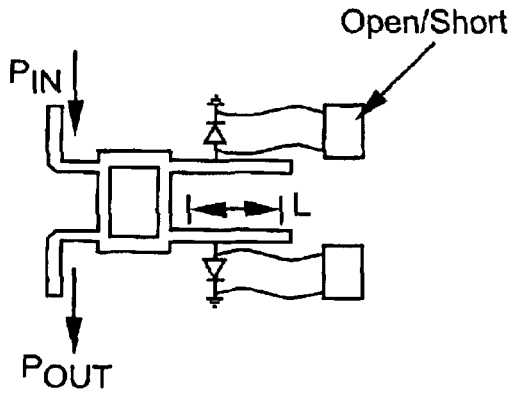
FIG. 8A Prior Art
FIG. 8*a* is a schematic diagram of a conventional phase shifter bit using pin diodes.
Figure 8B:
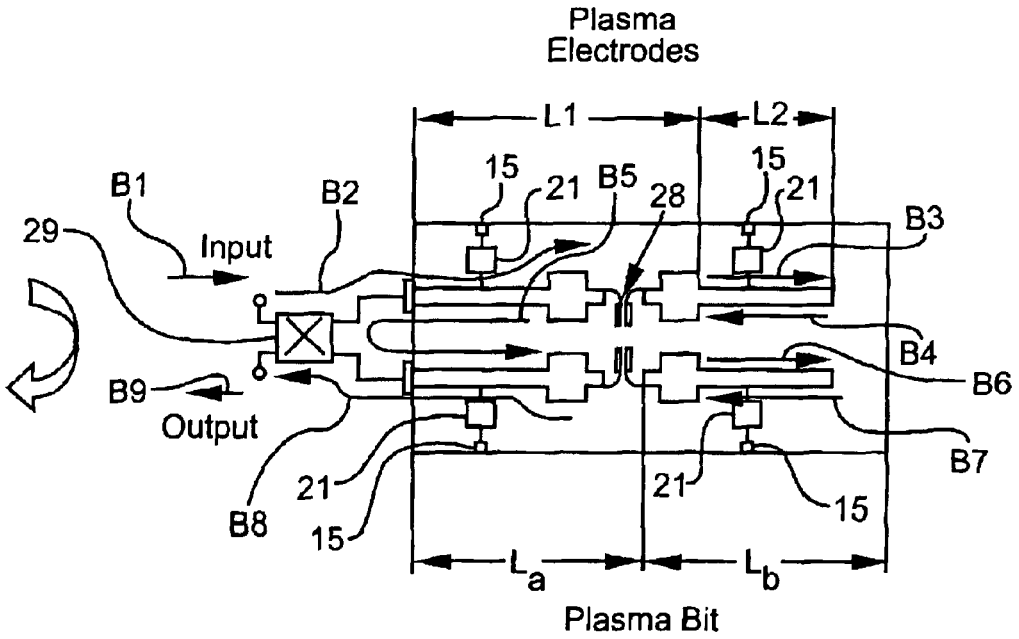
FIG. 8*b* is a schematic diagram of a phase shifter bit for use in the electronically scanned antenna array formed in accordance with the present invention.

The present invention essentially uses a plasma phase shifting device in place of the conventional pin diode phase shifting elements in an antenna array. As shown in FIG. 8*b*, plasma electrodes 28 are preferably used as on/off switches in the phase shifter bit. The advantages of plasma devices over pin diodes include the following:

1. plasma hysteresis provides a latching or memory function;
2. latching capability substantially reduces the number of drivers required to perform the same function;
3. manufacturing is simplified by providing the complete design including electrodes on one printed circuit board; and
4. considerable cost savings are realized over conventional phased array systems.

The key to these advantages is the plasma hysteresis property. This property enables N+M drivers, where N is the number of rows and M is the number of columns in the matrix, to control an N×M-element phased array antenna, as opposed to the conventional N×M drivers required in pin diode or ferrite designs. Thus, the present invention provides a substantial reduction in the cost and weight of the resulting antenna system.

Technology Comparison

The cost savings of a plasma-scanning array is best shown by the following example. Consider a two-dimensional phased array scanning antenna preferably operating at 7.9 GHz. This antenna preferably has nominal dimensions of 60 inches by 60 inches. If the array is to scan over a sector of ±45° in azimuth and ±45° in elevation, it would require about 3800 radiating elements (N=62 rows by M=62 columns). A phase shifter preferably feeds each element. Tables 3 and 4 provide a comparison between fabricating such an antenna using conventional pin diode phase shifters with that of an antenna formed in accordance with the present invention using plasma devices.

Conventional Approach

Phase shifters at the X-band cost about $300/unit in typical volumes. This price includes the phase shifting element and the electronic driver.

TABLE 3

Array Cost: Conventional Electronic Scanning

| | Each | (N × M) Number | Total |
|---|---|---|---|
| pin Diode Phase Shifter | $150 | 3800 | $570,000 |
| Drivers | $150 | 3800 | $570,000 |
| Support Structure | | | $20,000 |
| Integration & Test | | | $30,000 |
| BSU (Beam Steering Unit) | | | $15,000 |
| | | TOTAL | $1,205,000 |

Plasma Phase Shifter Element Approach

The plasma electrodes and interconnecting lines are preferably fabricated as a stripline printed circuit in accordance with the present invention.

TABLE 4

Array Cost: Plasma Phase Shifter Technology

| | Each | Number | Total |
|---|---|---|---|
| Plasma Electrode Printed Circuit | | 62 Boards | $12,400 |
| Drivers | $150 | 124 (N + M) | 18,600 |
| Support Structure | | | 20,000 |
| Integration & Test | | | 30,000 |
| BSU | | | 15,000 |
| | | Total: | $96,000 |

The projected cost of the plasma phased array antenna is greater than an order of magnitude less than that of the conventional approach. In addition, as the number of radiating elements increases, so too does the relative cost saving using the plasma approach.

Measured Results

A primary goal of the present invention is to use a pair of printed circuit electrodes, such that when fired they behave as an on/off RF (radio frequency) switch. These electrodes can then be used in place of pin diodes, as shown in FIG. 8*b*.

In a conventional array configuration employing pin diodes, the diodes are separately placed, deposited, or soldered on a printed microwave circuit. The portion of the circuit where the diodes are placed typically uses a high dielectric ceramic substrate. This is a relatively complicated process, which substantially increases the cost of the array.

In the embodiment formed in accordance with the present invention, the plasma electrodes are preferably an integral part of an inexpensive low-dielectric printed microwave circuit. Further, the electrodes are preferably manufactured in one step with the microwave circuit at no additional cost.

As shown in FIG. 8*b*, the path of the RF signal is shown by arrows B1–B9. The firing of the plasma electrodes preferably determines the length of the transmission line seen by the RF signal, and thus the applied phase delay. For instance, if the plasma electrodes are OFF, the RF signal preferably sees the plasma electrodes as a connected circuit, which reflects the RF signal after seeing a transmission line length of L1+L2 and the RF signal preferably follows a path indicated by arrows B1–B9. Thus, if the plasma electrodes are OFF, the RF signal preferably sees the entire transmission line indicated by arrows B1–B9. In this case, the RF signal is preferably reflected by those portions of the transmission line between arrows B3 and B4 and between arrows B6 and B7.

However, if the plasma electrodes are ON, the RF signal seesg the plasma electrodes as an open circuit, which disconnects the remaining length L2 of the transmission line. In this case the RF signal sees the transmission line length L1 only before being reflected. Thus, if the plasma electrodes are ON, the RF signal preferably see only that portion of the transmission line indicated by arrows B1, B2, B5, B8, and B9. In this case, the RF signal is preferably reflected by those portions of the transmission line between arrows B2 and B5 and between arrows B5 and B8. The plasma electrodes 28 are preferably energized at terminal 15 through series limiting resistors 21.

Figure 9A:
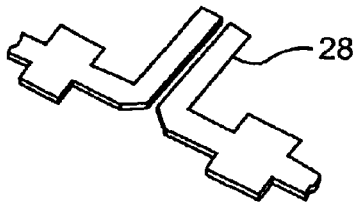
FIG. 9*a* is an enlarged view of a plasma electrode for use in the phase shifter bit shown in FIG. 8*b*.
Figure 9B:
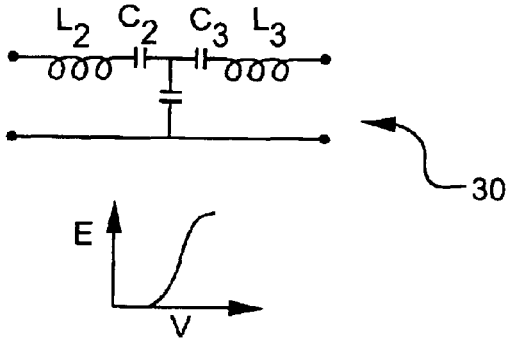
FIG. 9*b* is an equivalent circuit diagram of the plasma electrode shown in FIG. 9*a*.

The design of plasma electrodes 28 in accordance with the present invention involves parameters, such as dimension, dielectric constant, substrate material, gaseous properties, and impurities, as listed in FIG. 9*a*. An equivalent circuit 30 of the plasma electrode 28 is shown in FIG. 9*b* and is one of many possible embodiments for use in the antenna of the present invention. The electrodes 28 serve a dual purpose:

a) An RF stripline filter passband microwave circuit. The parameters are chosen to resonate at a particular RF frequency. With no plasma present, the circuit passes RF energy quite efficiently. This represents an RF switch in the on position.

b) When a triggering voltage is impressed across the electrodes 29, an electron stream discharge is preferably created across the gap between the electrodes 29 creating a plasma. The presence of the plasma causes the dielectric constant of the gas surrounding the electrodes 29 to increase dramatically from unity to a very high value. This preferably detunes the operating frequency of the passband filter and it becomes a stop band filter reflecting the energy at the frequency of interest. This represents an RF switch in the off position.

Single Bit Electrodes

Figure 10:
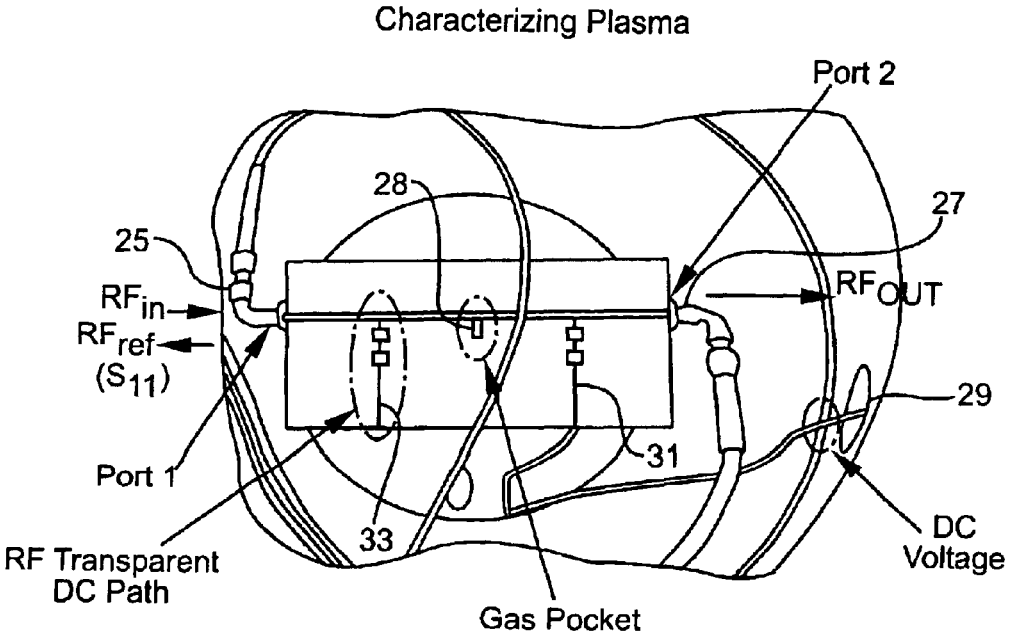
FIG. 10 is a pictorial view of an apparatus for testing the plasma electrode formed in accordance with the present invention.

An example of a pair of printed circuit electrodes 28 showing the glow from the plasma is shown in FIG. 10.

The electrodes 28 preferably fire at a voltage of about 300 volts when the Helium gas is at a pressure of about 20 Torr and a sufficient voltage is applied to the electrodes. The voltage is preferably applied to the electrodes 28 by the direct current (DC) voltage source 29 along paths 33, which are transparent to the radio frequency signal. When the plasma electrode 28 is not energized, the RF signal is allowed to pass from the input connector 25 to the output connector 27. When the plasma electrode 28 is energized, the circuit electrodes are detuned, thereby stopping the RF signal from passing to the output connector 27, and reflecting the RF signal back to the input connector 25.

Figure 11A:
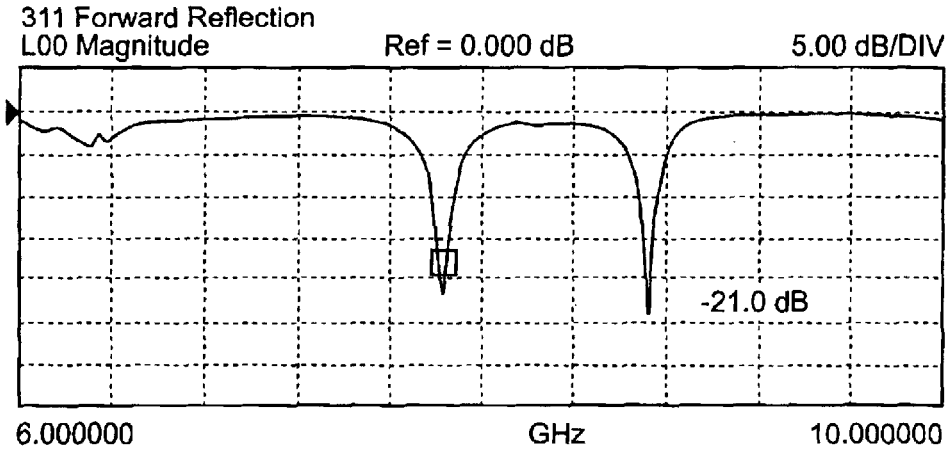
FIG. 11*a* is a graph of forward reflection as a function of frequency for the apparatus shown in FIG. 10 with the plasma off.
Figure 11B:
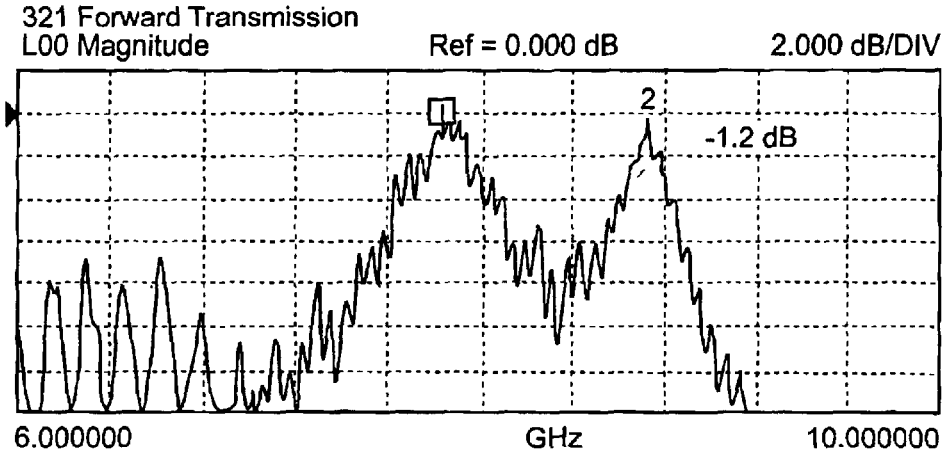
FIG. 11*b* is a graph of forward transmission as a function of frequency for the apparatus shown in FIG. 10 with the plasma off.

A top stripline plate has been removed to more clearly show the plasma glow between the electrodes 28. The test unit is preferably contained within a vacuum chamber having a glass view port. Measured data concerning individual stripline electrodes is provided in FIGS. 11*a* and 11*b* for the case when the switch is off (plasma off).

Figure 12A:
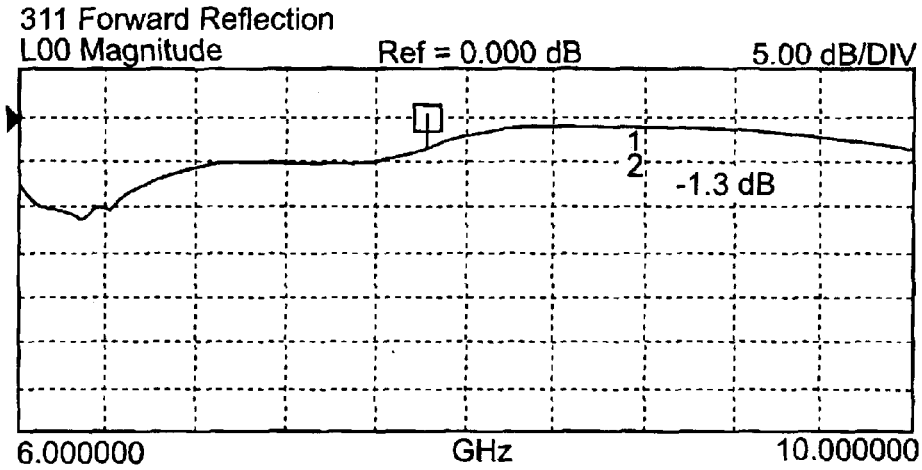

This particular tuned circuit preferably exhibits two distinct passbands. The upper band is preferably at about 8.7 GHz, has a return loss of about −21.0 dB (less than 1% reflection), and a relative insertion loss of about −1.2 dB. Most of the measured loss is due to the support test cables and transmission line. When the plasma is fired, the reflection and insertion losses exchange characteristics. This can be seen by comparing FIGS. 11*a* and 11*b* with FIGS. 12*a* and 12*b*, respectively.

Figure 12B:
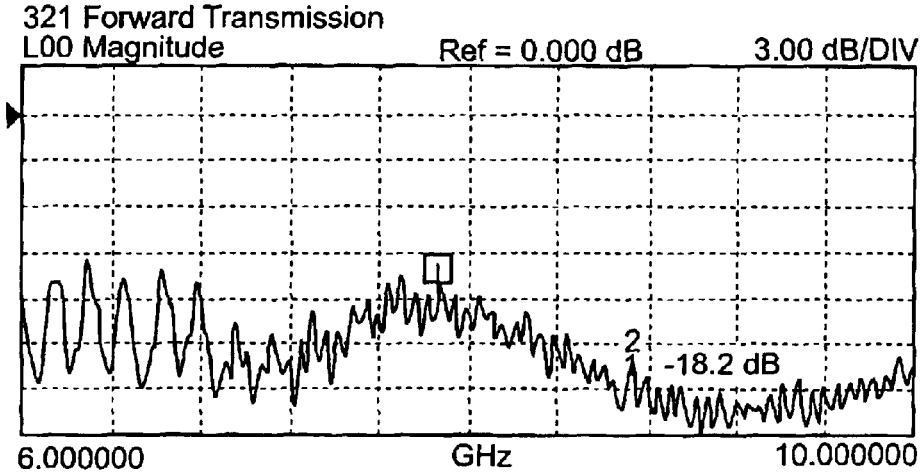

Insertion loss with no plasma is preferably within 0.1 dB of the reflection loss with plasma present (−1.2 dB versus −1.3 dB). FIG. 12*b* shows that the switch turns off the radio frequency signal to within a −18.2 dB level.

Printing two electrode pairs and a separating hybrid, as previously shown schematically in FIG. 8*b*, results in one phase shifter bit. However, several bits are preferably used in tandem to provide a more complete range of phases. Antenna arrays preferably use three to four bits in tandem. The value of each bit is preferably set by adjusting the termination line length TL to the right of the electrodes, as shown in FIG. 8*b*.

Figure 13:
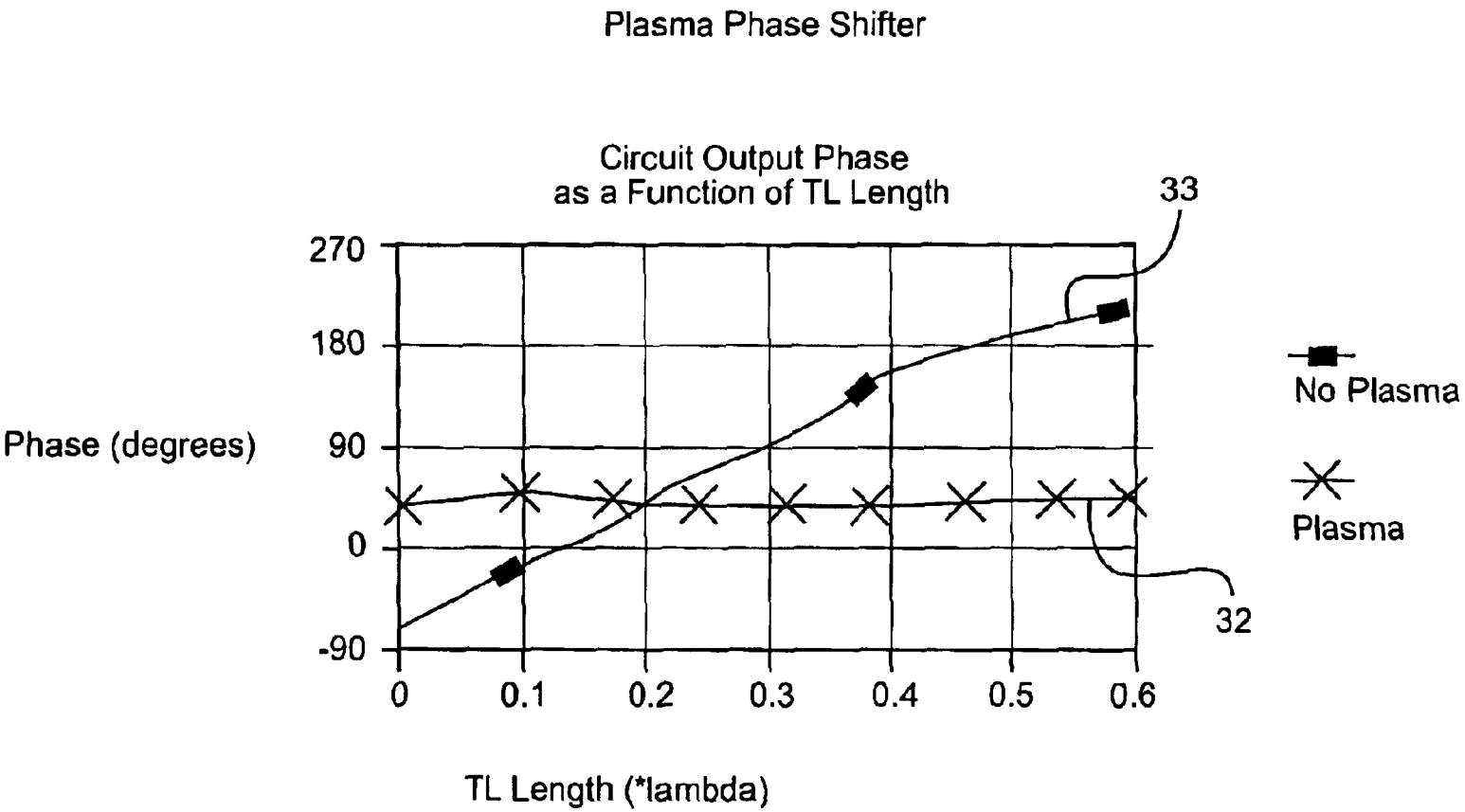
FIG. 13 is a graph of phase as a function of transmission line length for the plasma phase shifter formed in accordance with the present invention.

FIG. 13 shows the measured phase between the plasma 32 and no plasma 33 conditions as a function of termination length, and demonstrates that any bit is capable of being set to switch at any phase between 0 and 360 degrees (modulo $2\pi$). In a tandem three-bit configuration, bit #1 line length is preferably set to switch between 0° and 180°; bit #2 is preferably set to switch between 0° and 90°; and bit #3 is preferably set to switch between 0° and 45°. This results in eight (8) possible phase states since the total phase is the addition of each bit and each bit is preferably individually controllable. The development of these bits is essential to any phased array design.

Measured Hysteresis

As discussed above, one of the keys to developing a low-cost array is the use of the hysteresis properties inherent with plasma gas. The measured data for Helium is shown in FIG. 14 where the vertical axis is a measure of the plasma density/microwave interaction in decibel.

Figure 14:
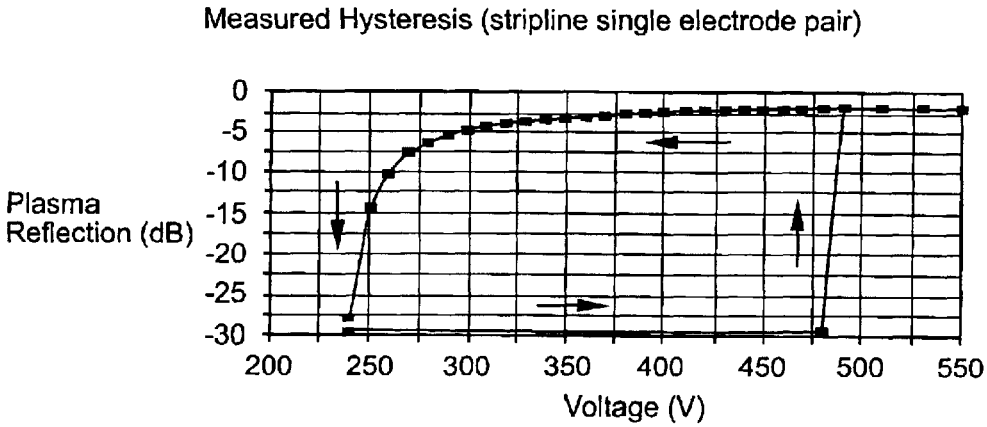
FIG. 14 is a graph of plasma reflection as a function of voltage for a stripline single plasma electrode formed in accordance with the present invention.

It can be seen from FIG. 14 that for Helium at a pressure of about 60 Torr, the plasma/microwave interaction preferably triggers at about 460 volts and preferably maintains the plasma down to about 300 volts. A sustaining voltage of about 400 volts is preferably used for this combination of gas and pressure. However, it is to be noted that different gases and pressures exhibit different hysteresis properties.

Proof-of-Principle Array

Thus, it has been experimentally demonstrated that a printed circuit plasma electrode can be used to implement a phase shifter bit in accordance with the present invention. The use of such a phase shifter bit to electronically scan an RF beam will now be described.

Figure 15:
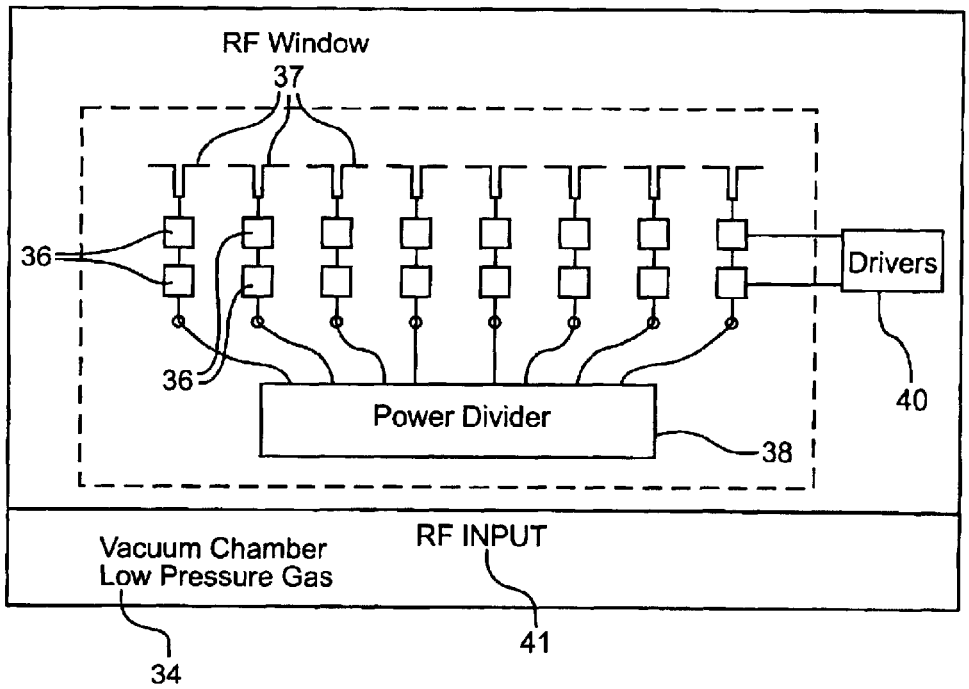
FIG. 15 is a block diagram of the electronically scanned array antenna formed in accordance with the present invention.

An eight-element laboratory line source array was fabricated and tested. This proof-of-principle array was not built for form or fit, but rather to demonstrate inertialess beam scanning. A block diagram of this array is shown in FIG. 15. The elements are as follows:

a) eight-element line source array 38;
b) RF printed circuit dipole radiators 37;
c) eight 2-bit phase shifters 36;
d) drivers (both row and column) 40;
e) a vacuum chamber 34; and
f) subcomponents coupled by coaxial cables.

Eight individual two-bit phase shifters 36 are preferably laid out, printed, fabricated, and tested. The printed circuit layout 32 of the two-bit phase shifter 36 is shown in FIGS. 16*a*, 16*b*, and 17*a*. The circuit 32 preferably includes RF tuned circuits, ratrace separators, and DC lines to apply the voltages that energize the individual plasma electrodes. The two bits are preferably capable of generating four distinct phase states with nominal relative values of 0°, 90°, 180°, and 270°. Upon initial fabrication, the phase shifters were individually tested and the results are summarized in FIG. 17*b*.

From FIG. 17*b* it can be seen that the first bit is near the desired nominal relative value of 90° (measured 96° average). It is to be noted that all fabricated units track within ±9°. It is also to be noted that the second bit deviates from the preferred value due to an error in printed circuit dimensions. A nominal relative value of 180° is preferred (measured 57° average with a variation of less than 2° unit to unit). The second bit termination line length was adjusted to bring it nearer the preferred value of about 180°.

Figure 18:
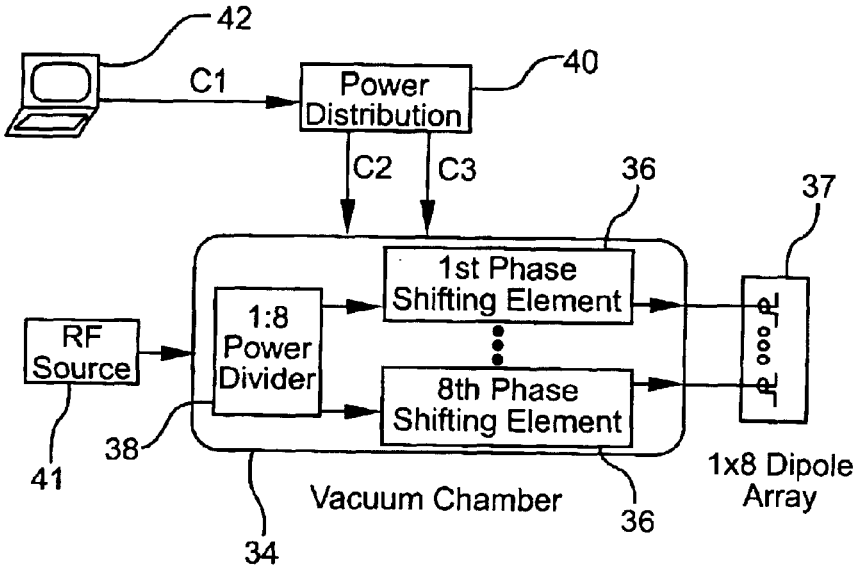
FIG. 18 is a block diagram of an antenna array system formed in accordance with the present invention.

The system block diagram for the proof of principle array is shown in FIG. 18. The system preferably includes a vacuum chamber 34 that houses the plasma-switchable two-bit phase shifters 36 with a 1:8 power divider 38. Using vacuum-fitted coaxial feed-throughs, coaxial cables are preferably used to connect an input RF source 41 and the eight dipole radiators 36 with the vacuum chamber 34.

Figure 19:
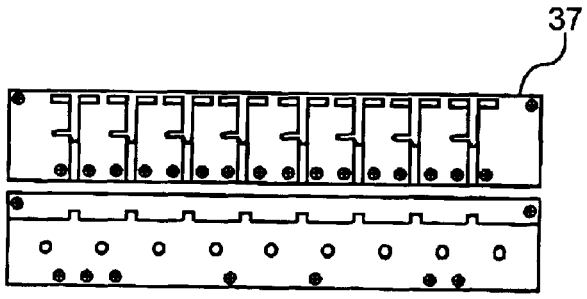
FIG. 19 are views of the system elements shown in FIG. 18.
Figure 19A:
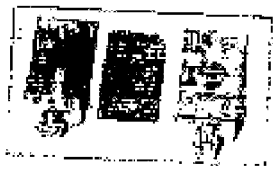
Figure 19B:
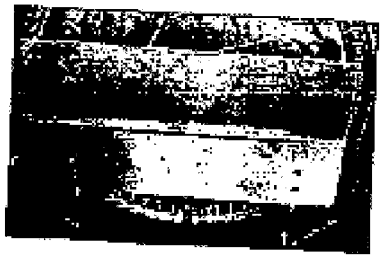
Figure 19C:
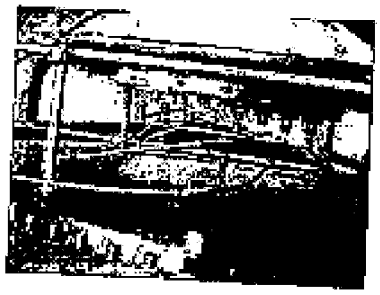
Figure 20:
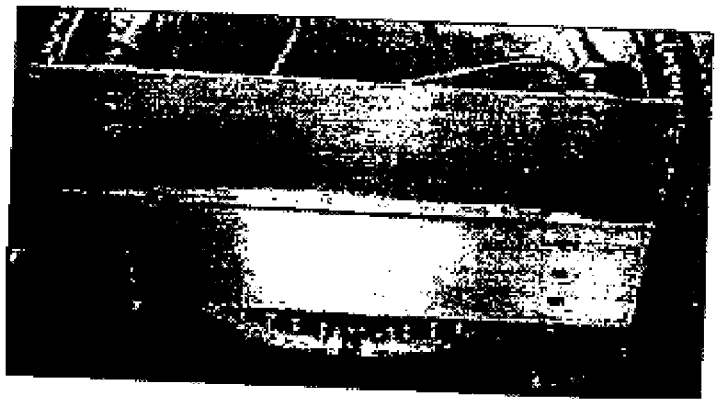
FIG. 20 is a top view of the plasma phased array formed in accordance with the present invention.

The plasma electrodes are preferably energized by a switchable power supply 40 for row and column driving, which is controlled by a personal computer 42. The system components of FIG. 18 are shown in FIG. 19 and a view of the 8 dipole radiators is shown in FIG. 20.

Figure 21A:
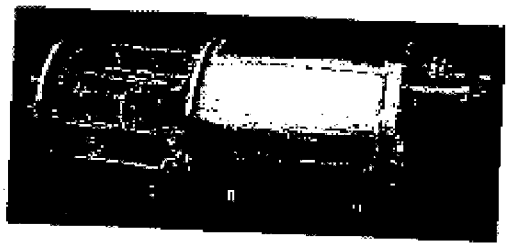
FIGS. 21*a* and 21*b* are side views of a vacuum chamber for use in the antenna array formed in accordance with the present invention.
Figure 21B:
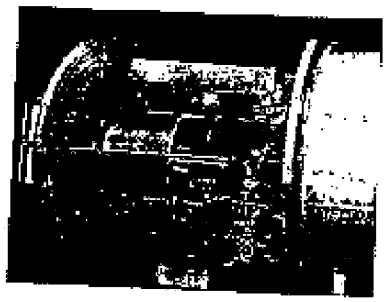

The disassembled vacuum chamber is shown in FIGS. 21*a* and 21*b*. The eight-element proof of principle plasma driven array was assembled, integrated, and tested in a compact reflector anechoic chamber 43, as shown in FIGS. 22*a* and 22*b*.

Figure 22A:
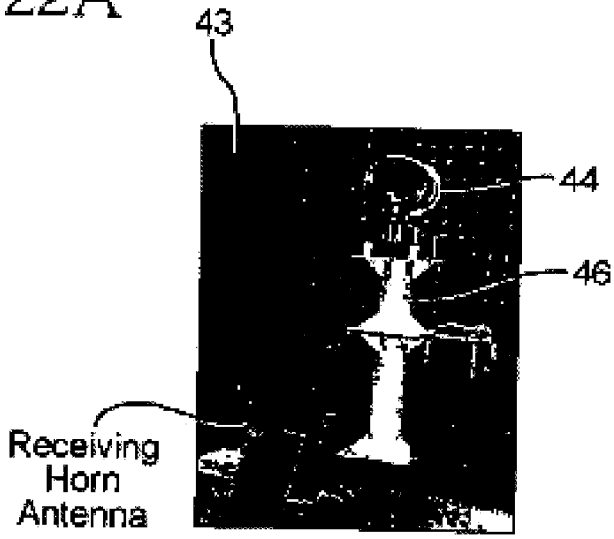
FIGS. 22*a* and 22*b* are front views of a test setup for the antenna array formed in accordance with the present invention.
Figure 22B:
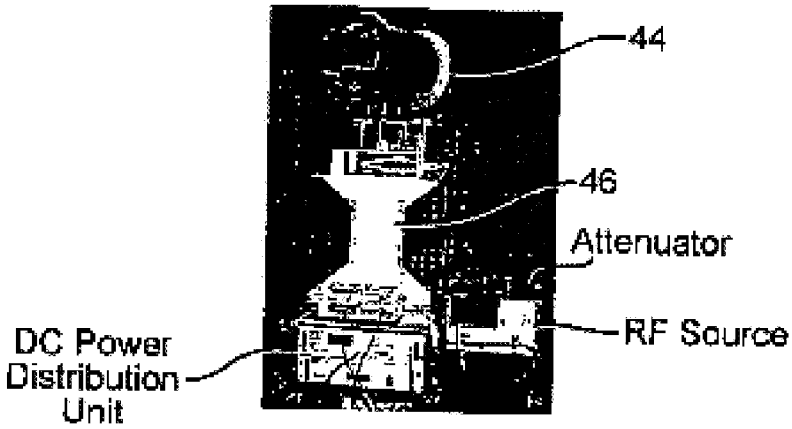
Figure 23:
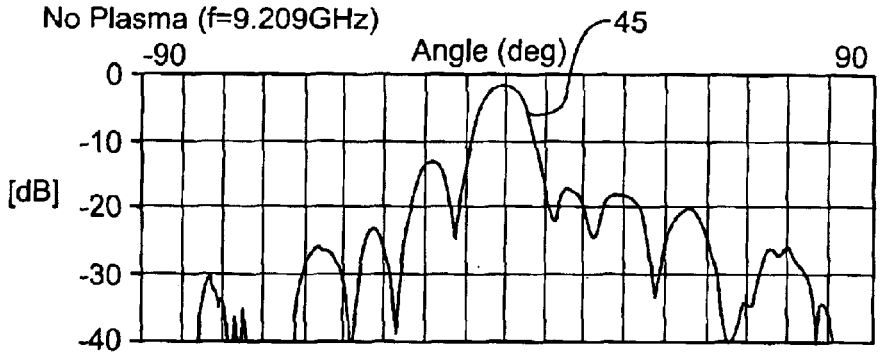
FIGS. 23–25 are graphs of the antenna patterns exhibited by the test setup shown in FIGS. 22*a* and 22*b*.
Figure 24:
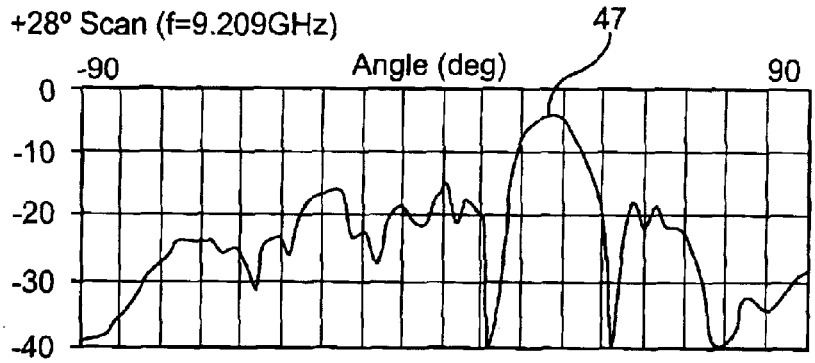
Figure 25:
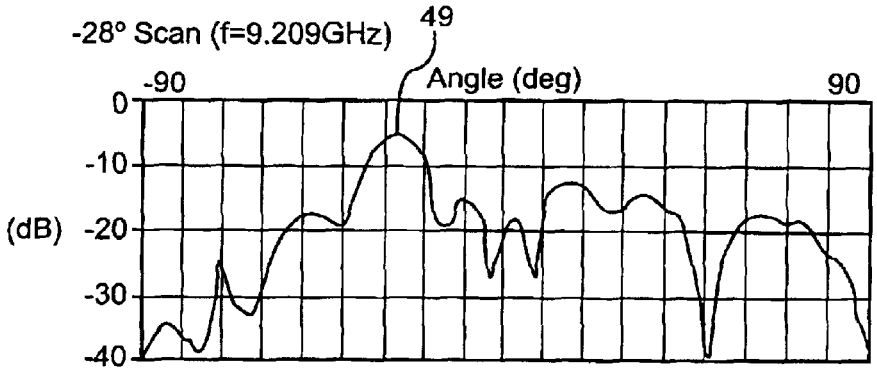

The dipole array 44 and phase shifters in the vacuum chamber 43 are preferably mounted on an azimuth rotator or pedestal 46 shown in FIGS. 22*a* and 22*b*. Antenna patterns were obtained with the phase shifters set to scan the beam at various positions. Samples of the measured patterns are shown in FIGS. 23–25. A first pattern 45 shown in FIG. 23 represents the beam derived by not energizing any electrodes, which results in a beam at broadside (0° scan).

The array is preferably able to be scanned over a region of ±28 degrees, which is determined by the chosen dipole element spacing. Patterns 47 and 49 shown in FIGS. 24 and 25, respectively, represent the two scanning extremes (±28 degrees).

It is to be noted that the quality of the beam is degraded when only two-bit phase shifters are used. Although the phase shifters were designed with two bits for ease of fabrication, the antenna patterns 45, 47, 49 clearly show that the beam has the capability of being scanned using plasma driven technology in accordance with the present invention.

Two-Dimensional Array

The next embodiment formed in accordance with the present invention includes a full two-dimensional array that can preferably be scanned in two axis planes (elevation and azimuth). The phase shifter developed for the proof of principle array describe above and shown in FIG. 18 has two bits and may be too large for practical applications. Thus, it would be advantageous if the size of the individual bits, and thus the layout of a three bit-phase shifter could be significantly reduced from the prior embodiment.

Figure 26:
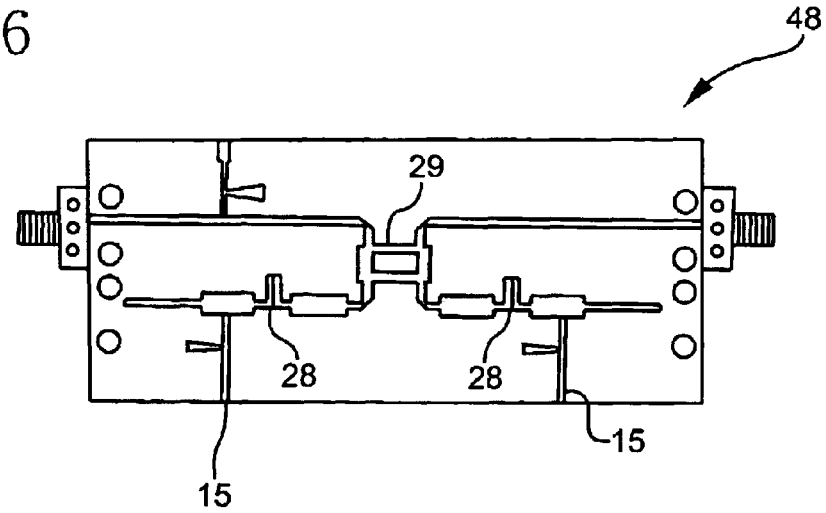
FIG. 26 is a pictorial view of a single phase shifting element formed in accordance with the present invention.
Figure 27A:
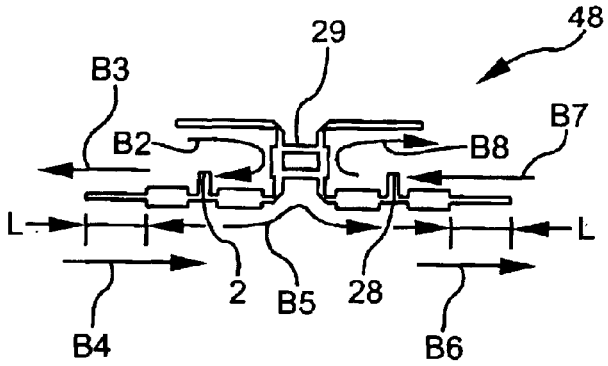
FIG. 27*a* is a graph of phase as a function of transmission line length concerning the single phase shifting element shown in FIG. 27*a*.

The reduced-size phase shifter bit configuration 48 is shown in FIGS. 26 and 27*a*. The preferred path of the RF signal is again shown by arrows B1–B8 in FIG. 27*a*. In this embodiment, the electrodes and associated resonant support elements are preferably made more compact. A separator is also preferably included in the stripline hybrid configuration.

Figure 27B:
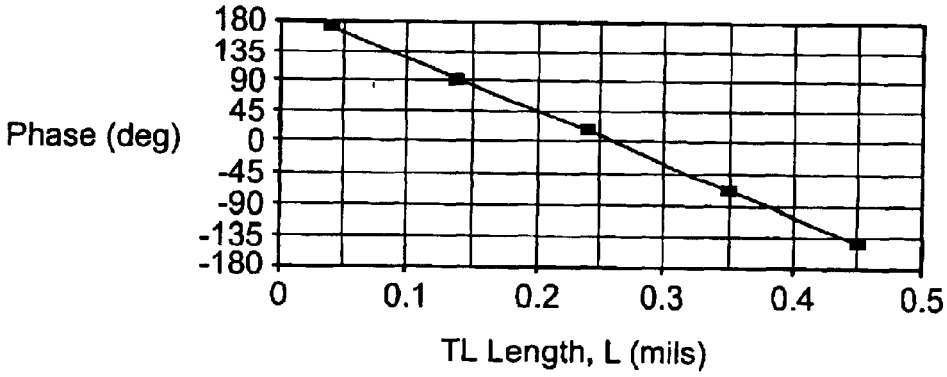
FIG. 27*b* is a block diagram of the single phase shifting element shown in FIG. 26.

Measured data for the two-dimensional array embodiment is shown in FIG. 27*b* wherein phase is plotted as a function of transmission line length. It can be seen that the full range of desired phases is possible just as with the first embodiment of the present invention described above.

Figure 28:
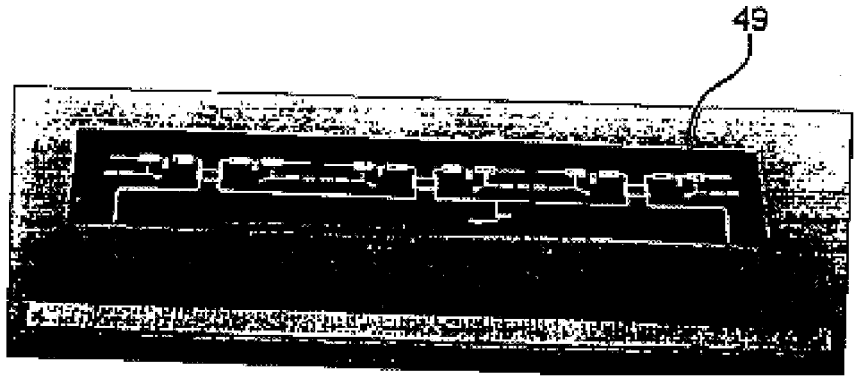
FIG. 28 is pictorial view of a three-bit plasma phase shifting element formed in accordance with the present invention.

Three bits are preferably laid out in tandem, as shown in FIG. 28. The three-bit phase shifter configuration 49 is preferably used in the two dimensional scanning array embodiment formed in accordance with the present invention.

The parameters of the two-dimensional are preferably summarized as follows:

a) X band frequency;

b) 256 elements;

c) 16 rows by 16 columns;

d) three bit phase shifters; and e) all printed circuit components.

Figure 29:
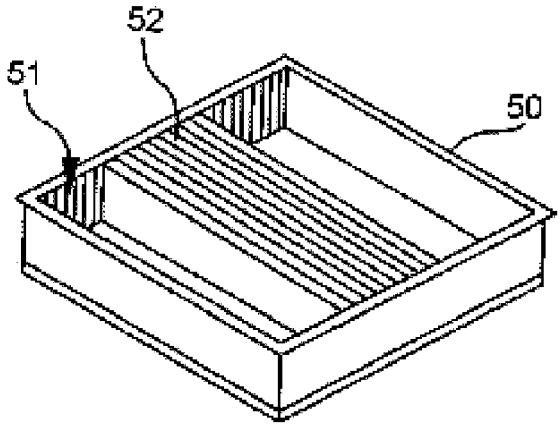
FIG. 29 is a top isometric view of a two-dimensional antenna array that may be scanned in azimuth and elevation.

Although there are many form factors that the array could assume, the form factor shown in FIG. 29 was selected due to its simplicity. The array preferably includes a box-like structure 50 having 16 slide-in panels 52. Each panel 52 preferably includes a line source of 16 dipole radiators resulting in the 256 element array face. The box 50 preferably includes an RF window 51 to permit the exchange of RF energy.

Figure 30:
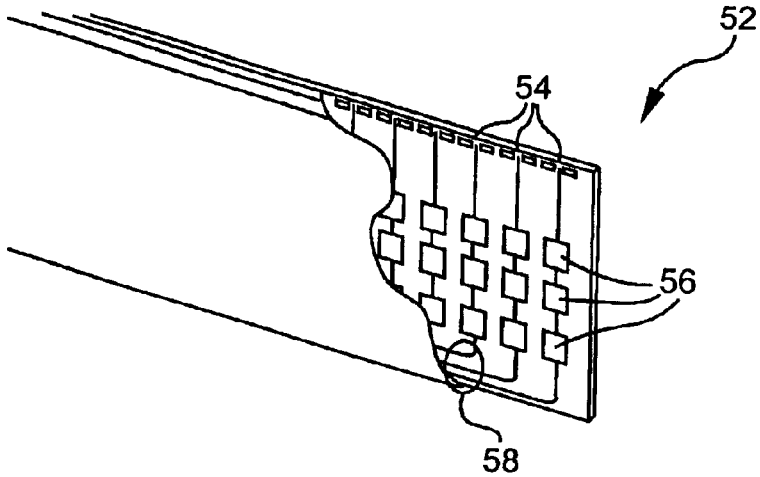
FIG. 30 is a simplified cutaway view of a line source panel for use in the two-dimensional antenna array shown in FIG. 29.
Figure 31:
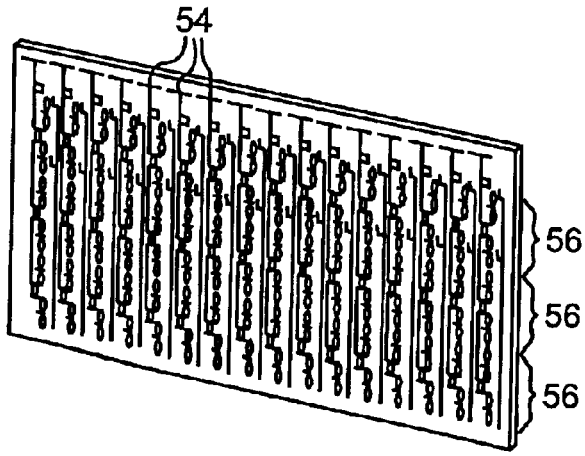
FIG. 31 is a detailed view of the line source panel shown in FIG. 30.
Figure 32:
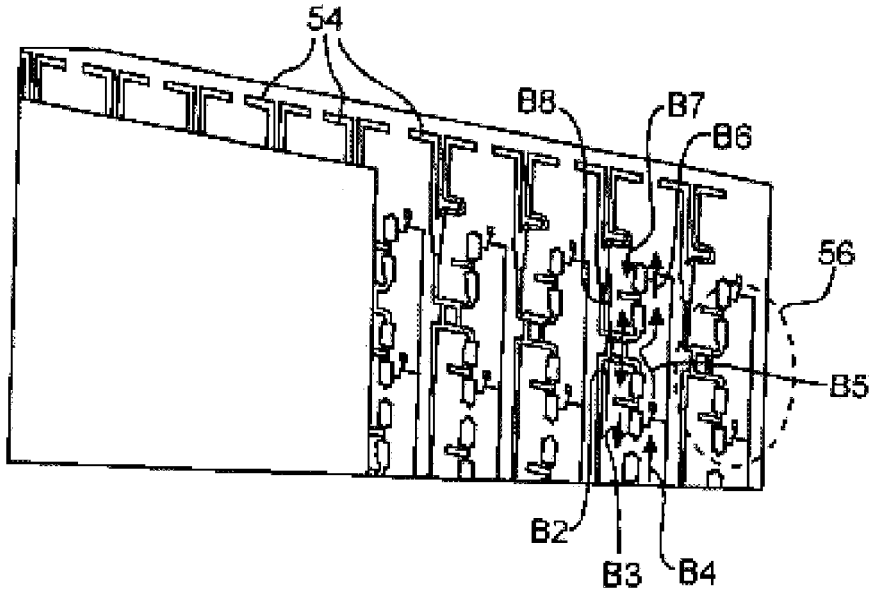
FIG. 32 is a partial cutaway view of the line source panel shown in FIG. 31.

As shown in FIG. 30, the line source panels 52 preferably conform to the form factor of the box 50 and include a stripline printed circuit. The stripline circuit preferably includes dipole radiators 54 at a top end, three-bit phase shifters 56 represented as square boxes, and an RF distribution network 58 at the bottom end. A preferred layout of the line source panels is shown in greater detail in FIGS. 31 and 32 where the actual bit configurations have been added. Arrows B2–B8 in FIG. 32 show the preferred path of the RF signal in accordance with FIG. 27*a*.

1×16 Panel Measurements

Figure 33:
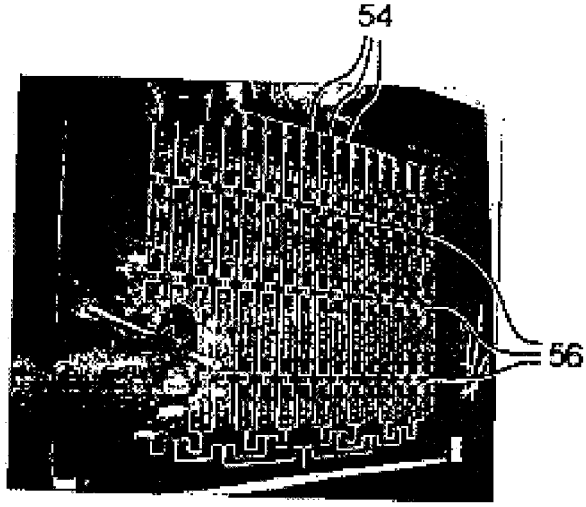
FIG. 33 is a stripline circuit card formed in accordance with the present invention.
Figure 34:
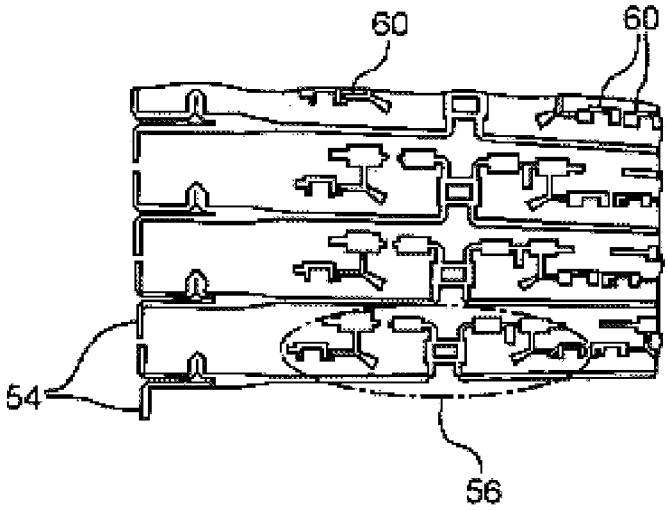
FIG. 34 is an expanded view of a portion of the circuit card shown in FIG. 33.

A 1×16 board assembly shown in FIG. 33 was laid out, fabricated, and tested. FIG. 34 shows a more detailed view, in which the dipole radiator 54, the first phase shifter bit 56 along with the current limiting resisters 60 that are soldered to the board, can be seen. Testing of the 1×16 circuit board assembly revealed the following concepts, which are discussed in greater detail below:

1) crosstalk between adjacent elements internal to the board;

2) manufacturing process; and 3) electrode lifetime.

Crosstalk

Figure 35:
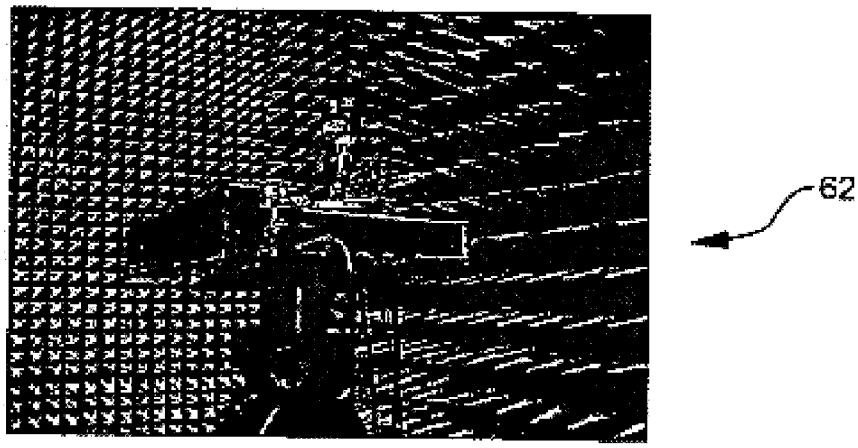
FIG. 35 is a test setup for the linear array circuit card shown in FIG. 33.
Figure 36:
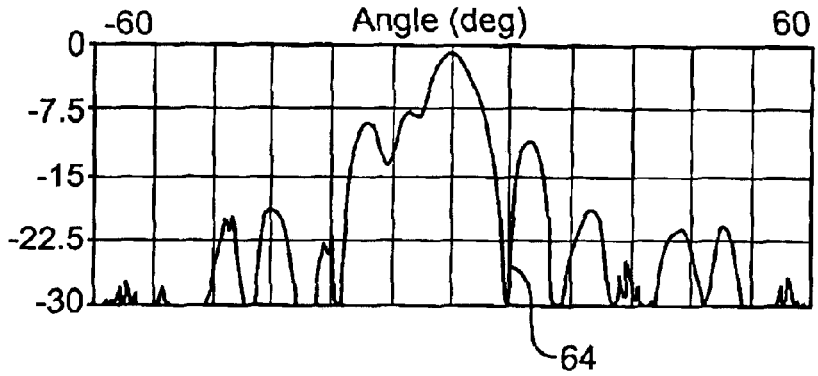
FIG. 36 is a graph of an antenna pattern exhibited by the stripline circuit card test setup shown in FIG. 35.

Radiation pattern measurements on the 16-element board shown in FIG. 33 indicated some degree of asymmetry in the patterns without the presence of any plasma. FIG. 35 shows a test fixture 62 for the 16-element array when mounted in an anechoic chamber for pattern measurements. A sample measured antenna pattern 64 for the 16-element board is shown in FIG. 36.

The pattern 64 is preferably symmetrical about the main beam. However, an asymmetry was traced to coupling within the circuit board due to sharp bends in the design. After additional simulation and analysis, this aspect was readily corrected within the circuit master negative and good isolation was achieved between adjacent phase shifters (better than −30 dB ). This aspect is important, since it permits numerous adjacent phase shifters to be closely spaced on a single circuit board. Since no further isolation techniques are required, such as shorting pins, fences, metal walls, and the like, the boards formed in accordance with the present invention can be fabricated inexpensively.

Manufacturing Process

To achieve acceptable antenna array radio frequency performance, the phase shifters preferably include two attributes:

a) good phase tracking; and b) low RF insertion loss.

Electrode Lifetime

Gas contamination appears related to electrode lifetime. Initially, circuits were made using the same copper as used in the circuit board. Tests showed that the copper electrodes disassociate and deplete very rapidly under plasma conditions. The life time was measured in hours (typically less than 10 hours). In less than 4 hours the gas would stop firing but would regain its performance properties if the cell was refreshed with a new gas charge. At about 10 hours the electrode would essentially deplete, break, and not fire.

Figure 37A:
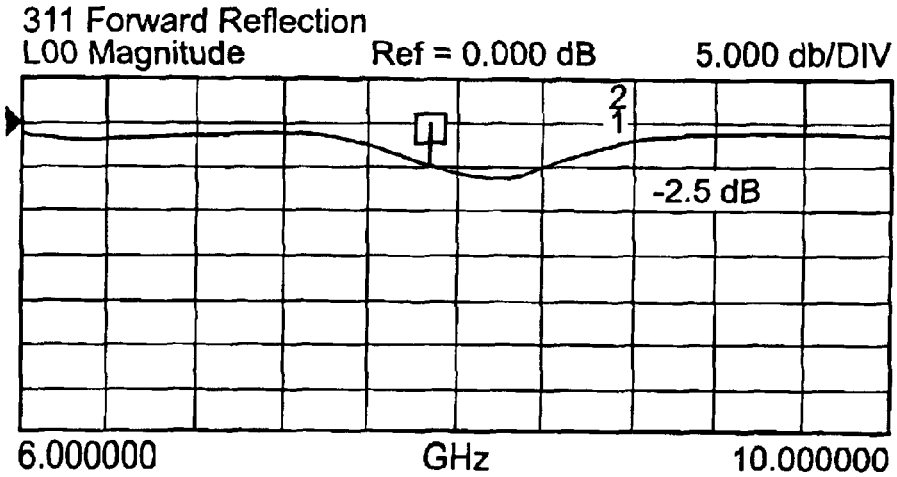
Figure 37B:
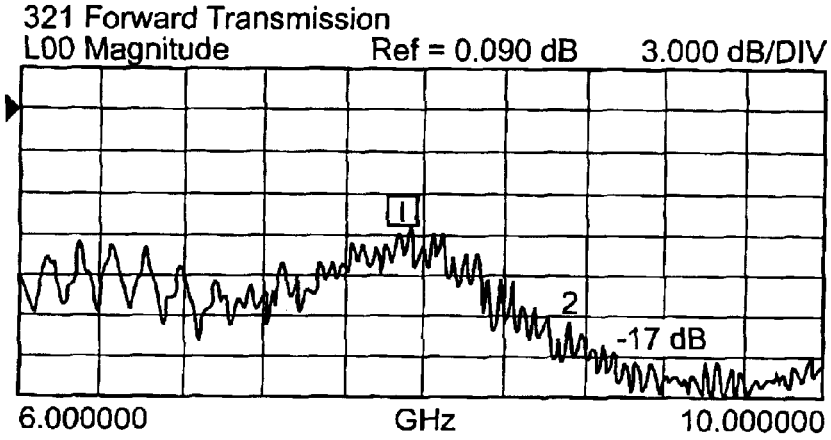
Figure 38A:
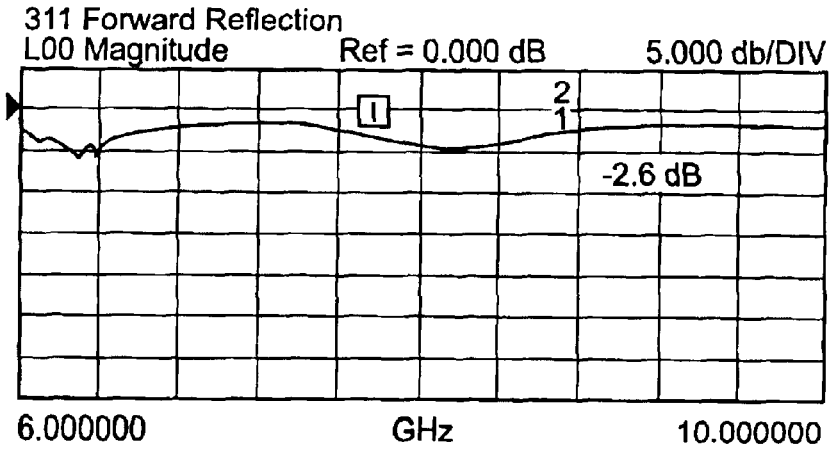
Figure 38B:
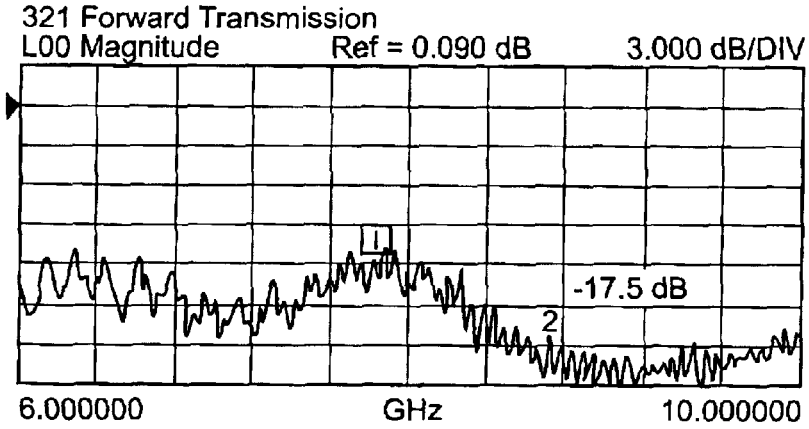

It was found that plating the electrodes significantly improved the lifetime performance. Tests were run using Nickel, Tin, Nickel Cobalt (shown in FIGS. 37 and 38), Zinc, and Nickel Tungsten. The lifetime of the electrodes, using Nickel/Cobalt plating was increased to over 100 hours limited only by the test duration. Brushless electroplating is likely the most convenient plating technique, but not necessarily the most robust.

It is to be understood that the signal directions described above may also be reversed such that, for instance, the antenna elements receive rather than transmit signals under the principles of reciprocity while remaining within the scope of the present invention.

Thus, the present invention provides an electronically scanned phase array antenna that is reliable, efficient, accurate, robust, compact, readily manufacturable in mass quantities, and cost-effective. The present invention also provides an electronically scanned antenna that utilizes plasma technology as a mechanism to shift the phase of signals in the array.

The electronically scanned phase array antenna of the present invention realizes the inherent advantages of plasma hysteresis to reduce the quantity of drivers required to energize phase shifting elements and includes plasma electrodes that may readily be fabricated using stripline or microstrip technology. The array antenna formed in accordance with the present invention may also be scanned in azimuth and elevation.

Although illustrative embodiments of the present invention have been described herein with reference to the accompanying drawing, it is to be understood that the invention is not limited to those precise embodiments, and that various other changes and modifications may be effected therein by one skilled in the art without departing from the scope or spirit of the invention.

What is claimed is:

1. A phased array antenna, which comprises:

a plurality of phase shifting elements, each of the plurality of phase shifting elements operatively coupled to at least one of a plurality of first signals, each of the plurality of phase shifting elements operatively coupled to at least one of a plurality of second signals, at least one of the plurality of phase shifting elements including at least one plasma electrode;

a plurality of drivers, at least one of the plurality of drivers selectively energizing the at least one plasma electrode, the plurality of phase shifting elements providing a phase shift between at least one of the plurality of first signals and at least one of the plurality of second signals in response to the at least one plasma electrode being selectively energized; and a plurality of antenna elements, each of the plurality of antenna elements being operatively coupled to at least one of the plurality of phase shifting elements.

2. A phased array antenna as defined by claim 1, further comprising a power divider, the power divider at least one of dividing an input signal into the plurality of first signals and coupling the plurality of first signals into an output signal.

3. A phased array antenna as defined by claim 2, further comprising a vacuum chamber, the power divider and the plurality of phase shifting elements being disposed in the vacuum chamber.

4. A phased array antenna as defined by claim 3, wherein the vacuum chamber is filled with at least one of Helium and Xenon.

5. A phased array antenna as defined by claim 3, wherein the vacuum chamber is filled with a gas at less than atmospheric pressure.

6. A phased array antenna as defined by claim 1, wherein the at least one plasma electrode is fabricated using stripline technology.

7. A phased array antenna as defined by claim 1, wherein the at least one plasma electrode is fabricated using microstrip technology.

8. A phased array antenna as defined by claim 1, wherein the plurality of antenna elements includes an array of N rows of antenna elements and M columns of antenna elements.

9. A phased array antenna as defined by claim 8, further comprising N+M drivers.

10. A phased array antenna as defined by claim 1, wherein at least one of the plurality of first signals are inputted to at least one of the plurality of phase shifting elements, at least one of the plurality of second signals being outputted from at least one of the plurality of phase shifting elements, at least one of the plurality of antenna elements being operatively responsive to at least one of the plurality of second signals.

11. A phased array antenna as defined by claim 1, wherein at least one of the plurality of second signals are inputted to at least one of the plurality of phase shifting elements from at least one of the plurality of antenna elements, at least one of the plurality of first signals being outputted from at least one of the plurality of phase shifting elements.

12. A phased array antenna as defined by claim 1, wherein at least one of the plurality of antenna elements includes at least one dipole.

13. A phased array antenna as defined by claim 1, wherein at least one of the plurality of phase shifting elements provides a phase shift between at least one of the plurality of first signals and at least one of the plurality of second signals such that at least one of the plurality of antenna elements are scanned in at least one of azimuth and elevation.

14. A phased array antenna as defined by claim 1, wherein the at least one plasma electrode selectively couples a transmission line between at least one of the plurality of first signals and at least one of the plurality of second signals in response to being at least one of selectively energized and de-energized.

15. A method of phase shifting an array antenna, the method comprising the steps of:

providing a plurality of phase shifting elements;

coupling each of the plurality of phase shifting elements operatively to at least one of a plurality of first signals;

coupling each of the plurality of phase shifting elements operatively to at least one of a plurality of second signals;

incorporating at least one plasma electrode in at least one of the plurality of phase shifting elements;

energizing the at least one plasma electrode selectively;

shifting the phase between at least one of the plurality of first signals and at least one of the plurality of second signals in response to the at least one plasma electrode being selectively energized; and coupling a plurality of antenna elements operatively to at least one of the plurality of second signals.

16. A method of phase shifting an array antenna as defined by claim 15, further comprising the step of dividing an input signal into the plurality of first signals.

17. A method of phase shifting an array antenna as defined by claim 15, further comprising the step of disposing a power divider and the plurality of phase shifting elements in a vacuum chamber.

18. A method of phase shifting an array antenna as defined by claim 17, further comprising the step of filling the vacuum chamber with at least one of Helium and Xenon.

19. A method of phase shifting an array antenna as defined by claim 17, further comprising the step of filing the vacuum chamber with a gas at less than atmospheric pressure.

20. A method of phase shifting an array antenna as defined by claim 15, further comprising the step of fabricating the at least one plasma electrode using stripline technology.

21. A method of phase shifting an array antenna as defined by claim 15, further comprising the step of fabricating the at least one plasma electrode using microstrip technology.

22. A method of phase shifting an array antenna as defined by claim 15, wherein the step of providing a plurality of antenna elements includes the step of providing an array of N rows of antenna elements and M columns of antenna elements.

23. A method of phase shifting an array antenna as defined by claim 22, further comprising the steps of:

providing N+M drivers; and energizing the at least one plasma electrode selectively.

24. A method of phase shifting an array antenna as defined by claim 15, further comprising the steps of:

inputting at least one of the first signals to at least one of the plurality of phase shifting elements;

outputting at least one of the plurality of second signals from at least one of the plurality of phase shifting elements; and responding to at least one of the plurality of second signals by at least one of the plurality of antenna elements operatively.

25. A method of phase shifting an array antenna as defined by claim 15, further comprising the steps of:

inputting at least one of the plurality of second signals to at least one of the plurality of phase shifting elements from at least one of the plurality of antenna elements; and outputting at least one of the plurality of first signals from at least one of the plurality of phase shifting elements.

26. A method of phase shifting an array antenna as defined by claim 15, further comprising the step of coupling a transmission line selectively between at least one of the plurality of first signals and at least one of the plurality of second signals in response to the at least one plasma electrode being at least one of selectively energized and de-energized.

27. A method of phase shifting an array antenna as defined by claim 15, further comprising the step of coupling the plurality of first signals into an output signal.

28. A phased array antenna system, which comprises:

a plurality of phase shifting elements, each of the plurality of phase shifting elements operatively coupled to at least one of a plurality of first signals, each of the plurality of phase shifting elements operatively coupled to at least one of a plurality of second signals, at least one of the plurality of phase shifting elements including at least one plasma electrode;

a plurality of drivers, at least one of the plurality of drivers selectively energizing the at least one plasma electrode, the plurality of phase shifting elements providing a phase shift between at least one of the plurality of first signals and at least one of the plurality of second signals in response to the at least one plasma electrode being selectively energized, the at least one plasma electrode selectively coupling a transmission line between at least one of the plurality of first signals and at least one of the plurality of second signals in response to being at least one of selectively energized and de-energized;

a plurality of antenna elements, each of the plurality of antenna elements being operatively coupled to at least one of the plurality of phase shifting elements, at least one of the plurality of first signals being inputted to at least one of the plurality of phase shifting elements, at least one of the plurality of second signals being outputted from at least one of the plurality of phase shifting elements, at least one of the plurality of antenna elements being operatively responsive to at least one of the plurality of second signals; and a power divider, the power divider dividing an input signal into the plurality of first signals.

29. A phased array antenna system as defined by claim 28, wherein the plurality of antenna elements includes an array of N rows of antenna elements and M columns of antenna elements.

30. A phased array antenna system as defined by claim 29, further comprising N+M drivers.

31. A phased array antenna system as defined by claim 28, wherein at least one of the plurality of phase shifting elements provides a phase shift between at least one of the plurality of first signals and at least one of the plurality of second signals such that at least one of the plurality of antenna elements are scanned in at least one of azimuth and elevation.

* * * * *